United States Patent [19]

Wu

[11] 4,247,212

[45] Jan. 27, 1981

[54] PRINTER FLATEN CLUTCH

[75] Inventor: Edward S. Wu, Chelmsford, Mass.

[73] Assignee: Wang Laboratories, Inc., Lowell, Mass.

[21] Appl. No.: 44,184

[22] Filed: May 31, 1979

[51] Int. Cl.[3] ..... B41J 11/24; B41J 19/96

[52] U.S. Cl. ..... 400/556.2; 400/559.1

[58] Field of Search ..... 400/559.1, 559, 556, 400/560, 556.2, 556.4

[56] References Cited

U.S. PATENT DOCUMENTS

| | | | |
|---|---|---|---|
| 1,142,787 | 6/1915 | Landsiedel | 400/556.2 |
| 1,143,212 | 6/1915 | Lockwood | 400/556.2 |
| 1,496,940 | 6/1924 | Myers | 400/556.2 |
| 1,831,955 | 11/1931 | Harvey | 400/556.2 |
| 2,554,754 | 5/1951 | Prezloso | 400/556.2 |
| 3,880,016 | 4/1975 | Jamieson et al. | 400/556.2 |
| 4,105,106 | 8/1978 | Geis | 400/556.2 |

FOREIGN PATENT DOCUMENTS

| | | | |
|---|---|---|---|
| 308460 | 3/1929 | United Kingdom | 400/559.1 |
| 718253 | 11/1954 | United Kingdom | 400/559.1 |
| 436372 | 10/1926 | Fed. Rep. of Germany | 400/559.1 |

*Primary Examiner*—William Pieprz

[57] ABSTRACT

A printer having a platen mounted on a platen shaft and a line indexing driving gear includes releasable coupling means selectively coupling the platen shaft and driving gear for printer controlled or manual indexing of the platen. It includes an external clutch member rotatably mounted on the shaft and axially moveable therealong, an internal clutch member fixedly mounted on the shaft outwardly of the external clutch member and having on its inner end an external cone clutch element normally engaged with the internal clutch element and a manual clutch disengaging member mounted for axial movement on the shaft outwardly of the internal clutch member. The external clutch member has on its inner end a driven gear engaging the driving gear throughout the axial movement of the external clutch member and on its outer end an internal serrated cone clutch element, the internal clutch member has axially extending through opening means spaced radially inwardly of the external clutch element, and the clutch disengaging member has on its outer end an actuating knob and on its inner end axially extending actuating means extending through the opening means for axially moving the external clutch member inwardly to disengage the clutch elements for manual rotation of the platen by the knob.

1 Claim, 3 Drawing Figures

FIG 1
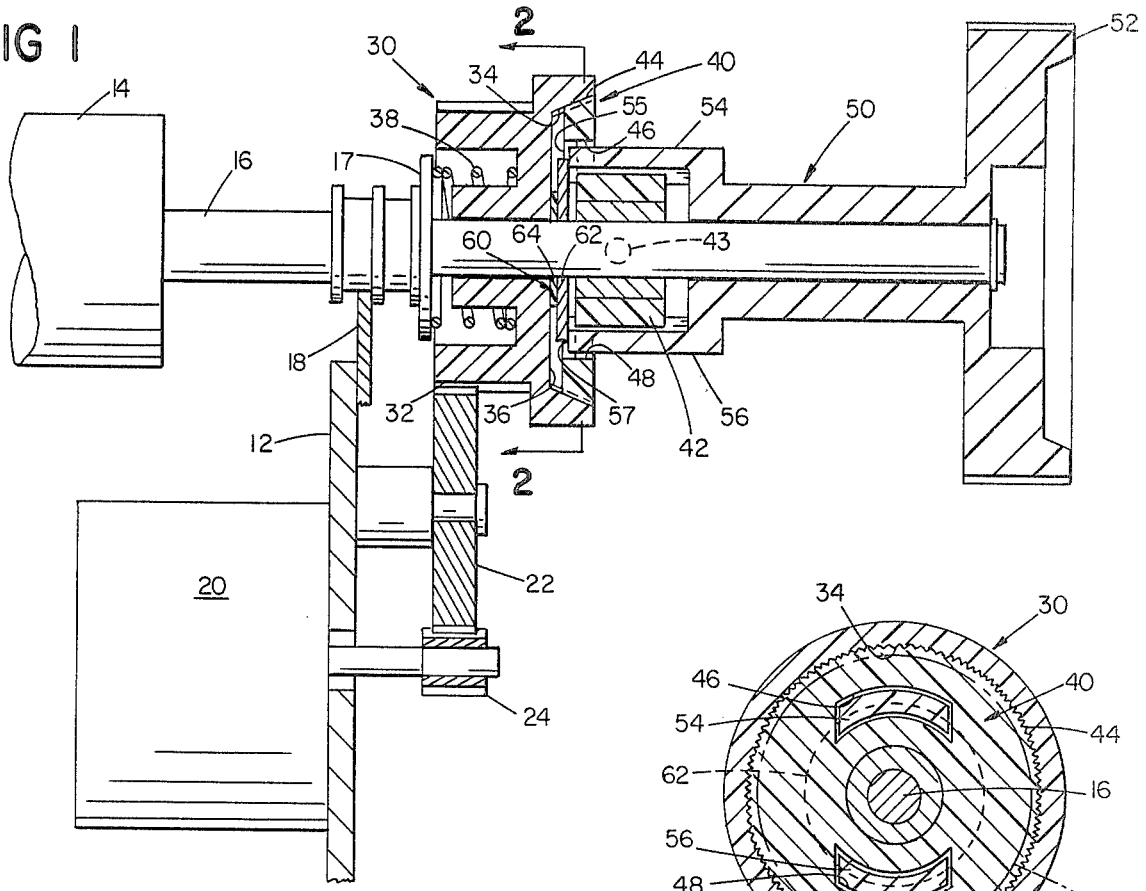
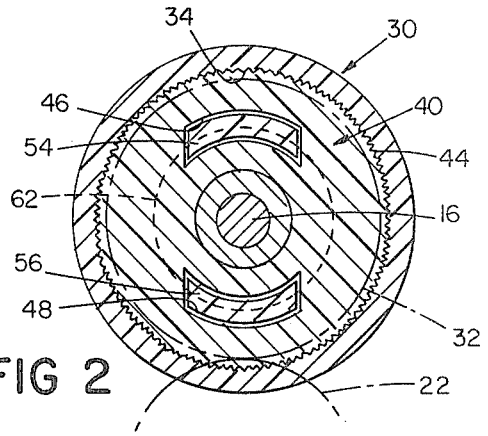
FIG 2
FIG 3
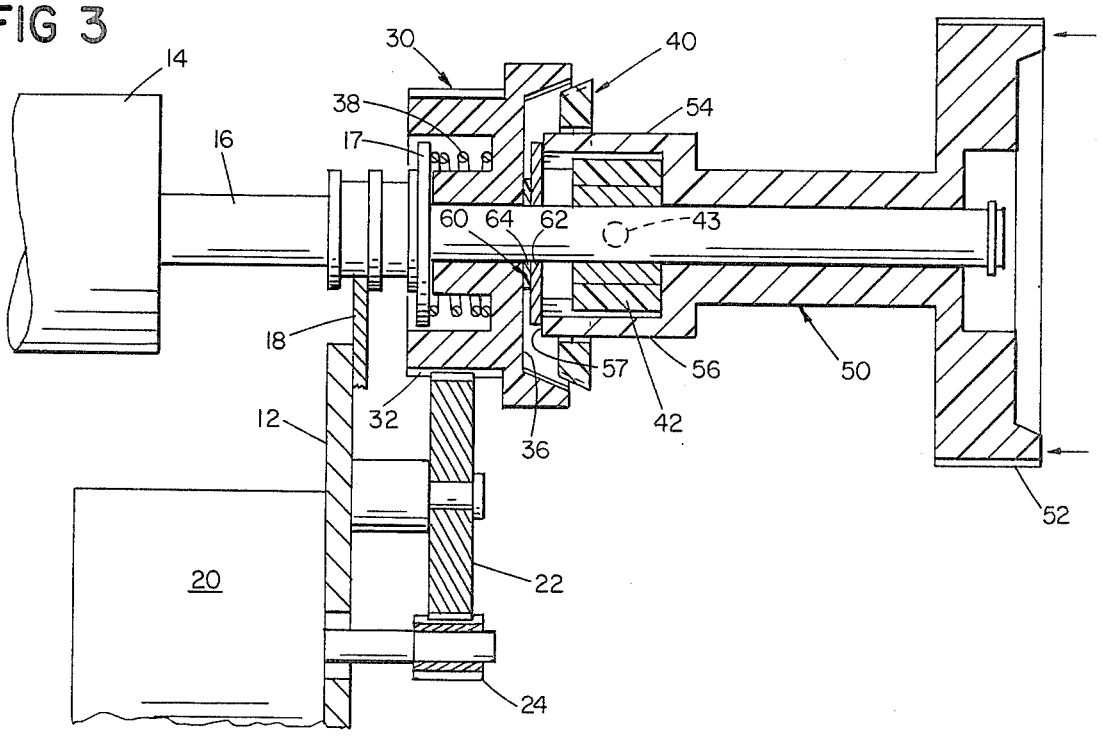

PRINTER FLATEN CLUTCH

BACKGROUND OF THE INVENTION

This invention relates to printers of the typewriter or dot matrix type and, more particularly, to mechanisms for selectively coupling their platen shaft and driving gear to allow printer controlled or manual indexing of the platen.

Printers of the typewriter or dot matrix type conventionally have a platen mounted on a shaft which is in turn rotatably mounted on the printer frame. During normal printing, the platen is advanced line-by-line. This may be printer controlled by a stepping motor, for example. Mechanism is also provided so that the platen may be disconnected from its printer controlled driving mechanism and rotated manually to index it as desired.

Although a wide variety of such mechanisms have been provided by the prior art, for example, as shown in U.S. Patent Nos. 3,880,016 and 4,105,106, they have all proved to be deficient in that they were unduly expensive to manufacture and failed to take advantage of less expensive construction made possible by the use of precision moulded plastic elements.

SUMMARY OF THE INVENTION

In general, the invention comprises, in a printer having a platen mounted on a platen shaft and a line indexing driving gear, releasable coupling means selectively coupling the platen shaft and driving gear for printer controlled or manual indexing of said platen.

More specifically, the novel releasable coupling means of the invention comprises an external clutch member rotatably mounted on the shaft and axially moveable therealong, a spring preferably interposed between the shaft and the external clutch member axially urging it in the outward direction, an internal clutch member fixedly mounted on the shaft outwardly of the external clutch member and having on its inner end an external cone clutch element normally engaged with the internal clutch element by the spring, and a manual clutch disengaging member mounted for axial movement on the shaft outwardly of the internal clutch member.

The external clutch member has on its inner end a driven gear engaging the driving gear throughout the axial movement of the external clutch member and on its outer end an internal serrated cone clutch element with an operating surface, preferably extending generally perpendicular to the shaft and located radially inwardly of the clutch element.

The internal clutch member has through opening means, preferably in the form of a pair of opposed axially extending through openings spaced radially inwardly of the external clutch element and outwardly of the boss element. The clutch disengaging member has on its outer end an actuating knob and, on its inner end, preferably a pair of axially extending actuating elements extending through the openings toward the external clutch member operating surface.

A force transmitting disk member having a low friction surface on its inner surface for contact with the operating surface is preferably interposed between the inner ends of the actuating elements and the clutch member operating surface.

With this novel mechanism, inboard axial movement of the clutch disengaging member axially moves the external clutch member inwardly to disengage the clutch elements to permit manual rotation of the platen by the knob.

OBJECTS OF THE INVENTION

It is a major object to the invention to provide a novel releasable coupling means for a printer platen which makes full use of precision molded plastic elements in order to reduce the cost of its manufacture, while at the same time reducing rotary play in its operating elements.

For a fuller understanding of further objects and features of the invention, reference is now made to the following detailed description of a preferred embodiment thereof, taken together with the accompanying drawings.

BRIEF DESCRIPTION OF THE DRAWINGS

FIG. 1 is a cross sectional view of the mechanism of the invention, showing its releasable coupling means in normal engaged position for printer controlled indexing of its platen;

FIG. 2 is a cross sectional view of the mechanism of FIG. 1, taken on line 2—2 thereof; and FIG. 3 is a cross sectional view similar to that of FIG. 1, but showing its releasable coupling means in disengaged position for manual indexing of its platen.

DETAILED DESCRIPTION

Referring to the drawings, a portion of a printer is shown, including a portion of its side frame 12 having platen 14 mounted on platen shaft 16 in frame bearings 18. Stepping motor 20 for printer controlled indexing of platen 14 is also mounted on side frame 12 for driving line indexing driving gear 22 through pinion 24.

In accordance with the present invention, a novel releasable coupling means is provided to allow for the selective coupling of platen shaft 16 and driving gear 22 for printer controlled or manual indexing of platen 14, the major elements of which are all formed of precision molded plastic material for ease in manufacture and assembly to provide a superior mechanism at lower cost.

More specifically, an external clutch member, generally designated 30, integrally molded of plastic material, is rotatably mounted on platen shaft 16 for limited axial movement therealong. External clutch member 30 has on its inner end a driven gear 32 engaging driving gear 22 throughout the axial movement of external clutch member 30. On its outer end, it has an outwardly facing internal serrated cone clutch element 34. Facing outwardly and spaced radially inwardly of clutch element 34 on member 30 is provided an operating surface 36 generally perpendicular to platen shaft 16, for utilization as hereinafter described. Compression spring 38 is interposed between flange 17 of platen shaft 16 and external clutch member 30 for axially urging external clutch member 30 in the outward direction away from printer end frame 12.

An internal clutch member, generally designated 40, also integrally molded of plastic material, is fixedly mounted on platen shaft 16 outwardly of external clutch member 30. It has on its outer end a shaft mounting boss element 42 having a set screw 43 by which it may be rigidly affixed to platen shaft 16. On its inner end it has an external serrated cone clutch element 44 which is normally engaged with internal clutch element 34 by spring 38 for printer controlled indexing. Internal clutch member 40 also has, on opposite sides of platen shaft 16, a pair of axially extending, generally rectangular, through openings 46 and 48 spaced radially inwardly of external clutch element 44 and outwardly of boss element 42 for utilization as hereinafter described.

A manual clutch disengaging member, generally designated 50, also of integrally molded plastic material, is rotatably mounted for limited axial movement on platen shaft 16 outwardly of internal clutch member 40. Clutch disengaging member 50 has on its outer end a manual actuating knob 52. On its inner end it has a pair of axially extending actuating elements 54 and 56 on opposite sides of platen shaft 16. Elements 54 and 56 are of generally rectangular cross section and extend through openings 46 and 48 with their free end surfaces 55 and 57 facing toward external clutch member operating surface 36. It is important that elements 54 and 56 fit closely within openings 46 and 48 to prevent rotary play.

A force transmitting member, generally designated 60, rotatably mounted on platen shaft 16, is interposed between the inner end surfaces 55 and 57 of actuating elements 54 and 56 and clutch member operating surface 36. Member 60 includes a steel disk 62 of sufficiently large diameter to be contacted by actuating element inner end surfaces 55 and 57 and, interposed between steel disk 62 and operating surface 36, a low friction nylon washer 64 of less diameter than steel disk 62, providing a low friction surface on the inner surface of member 60 for contact with operating surface 36 for reducing the frictional torque between external clutch member 30 and manual clutch disengaging member 50 when the latter is manually rotated.

In normal operation with printer controlled indexing of platen 14, stepping motor 20 rotates external clutch member 30 which in turn rotates internal clutch member 40 and platen shaft 16 through cone clutch elements 34 and 44 which are maintained in engagement by compression spring 38.

For manual indexing of platen 14, with stepping motor 20 stopped and so preventing external clutch member 30 from rotating, inward axial movement of clutch disengaging member 50 by pressing inward on its knob 52 axially moves external clutch member 30 inwardly to disengage clutch elements 34 and 44 to permit manual rotation of platen 14 by knob 52. The outer end of boss element 42 functions as a stop to limit inward movement of clutch disengaging member 50.

More specifically, upon inward axial movement of clutch disengaging member 50 against the force of spring 38, the ends of its actuating elements 54 and 56 engage steel disk 62 and move it inwardly toward operating surface 36 until it engages nylon washer 64 which in turn moves external clutch member 30 axially inwardly to disengage clutch elements 34 and 44 so that clutch disengaging member 40 can be manually rotated by knob 52 to index platen 14 as desired. The provision of low friction washer 64 reduces the frictional torque to allow easy rotation of platen 14 relatively to operating surface 36.

To return the printer to printer controlled indexing, it is only necessary to relieve the inward pressure on knob 52, whereupon spring 38 will return external clutch member 30 and clutch disengaging member 40 to their normal printer controlled indexing position.

What is claimed is:

1. In a printer having a platen mounted on a platen shaft and a line indexing driving gear, releasable coupling means selectively coupling said platen shaft and driving gear for printer controlled or manual indexing of said platen, comprising an external clutch member rotatably mounted on said shaft and axially moveable therealong, said external clutch member having on its inner end a driven gear engaging said driving gear throughout the axial movement of said external clutch member and on its outer end an internal serrated cone clutch element with an operating surface generally perpendicular to said shaft radially inwardly of said clutch element a compression spring interposed between said shaft and said external clutch member axially urging said external clutch member in the outward direction, and an internal clutch member fixedly mounted on said shaft outwardly of said external clutch member and having on its outer end a shaft mounting boss element and on its inner end an external cone clutch element normally engaged with said internal clutch element by said spring, said internal clutch member having a pair of opposed axially extending through openings spaced radially inwardly of said external clutch element and outwardly of said boss element a manual clutch disengaging member mounted for axial movement on said shaft outwardly of said internal clutch member, said clutch disengaging member having on its outer end an actuating knob and on its inner end a pair of axially extending actuating elements extending through said openings toward said external clutch member operating surface, and a force transmitting disk member interposed between the inner ends of said actuating elements and said clutch member operating surface and having a low friction surface on its inner surface for contact with said operating surface whereby, inboard axial movement of said clutch disengaging member axially moves said external clutch member inwardly to disengage said clutch elements for manual rotation of said platen by said knob.

* * * * *